United States Patent [19]

Critchley et al.

[11] 4,446,063

[45] May 1, 1984

[54] DISPOSAL OF RADIOACTIVE WASTE

[75] Inventors: Richard J. Critchley, Chorley; Roy J. Swindells, Stockport, both of England

[73] Assignee: British Nuclear Fuels Limited, Warrington, England

[21] Appl. No.: 310,842

[22] Filed: Oct. 13, 1981

[30] Foreign Application Priority Data

Oct. 29, 1980 [GB] United Kingdom ..... 8034763

[51] Int. Cl.[3] ..... G21F 9/22; G21F 5/00

[52] U.S. Cl. ..... 252/633; 250/506.1; 250/507.1; 422/903

[58] Field of Search ..... 252/633; 250/506, 507; 422/903

[56] References Cited

U.S. PATENT DOCUMENTS 4,016,096 4/1977 Meyer ..... 252/626

*Primary Examiner*—Deborah L. Kyle

*Attorney, Agent, or Firm*—Larson and Taylor

[57] ABSTRACT

A method and apparatus for charging radioactive waste into a disposable steel drum having a plug type lid. The drum is sealed to a waste dispenser and the dispenser closure and lid are withdrawn into the dispenser in back-to-back manner. Before reclosing the dispenser the drum is urged closer to it so that on restoring the dispenser closure to the closed position the lid is pressed into the drum opening.

4 Claims, 6 Drawing Figures

Fig. 1.
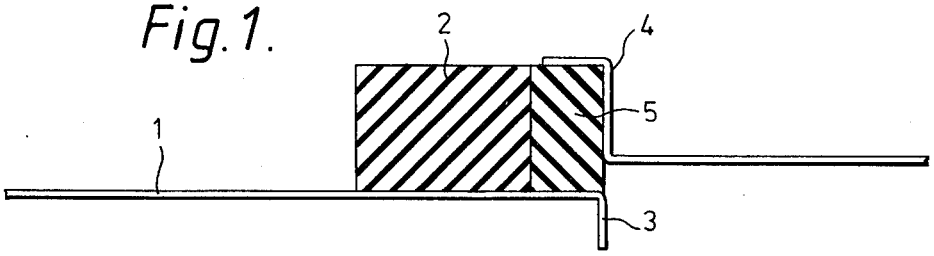
Fig. 2.
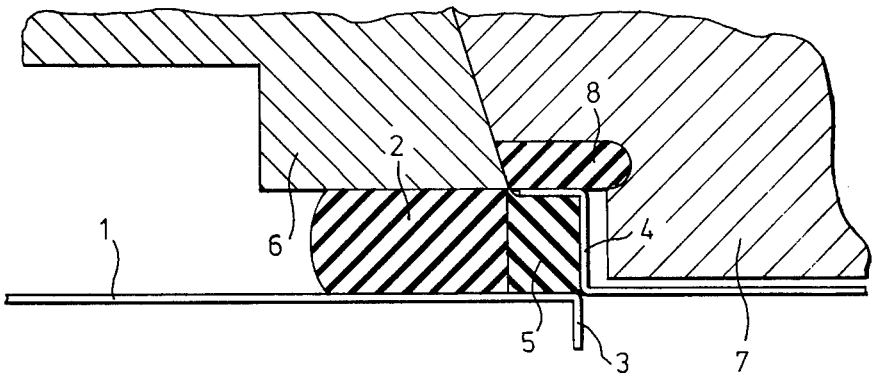
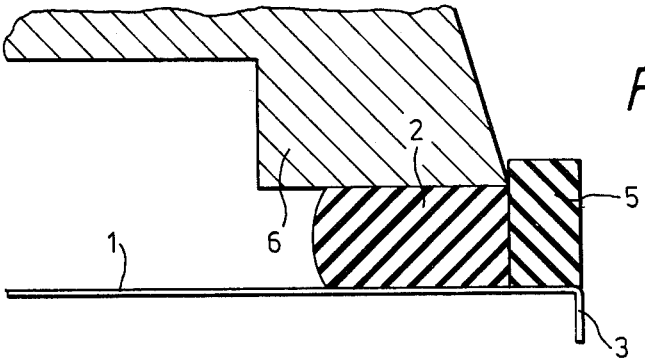
Fig. 3.

DISPOSAL OF RADIOACTIVE WASTE

BACKGROUND OF THE INVENTION

This invention relates to the disposal of radioactive waste.

Radioactive waste generated by the nuclear industry must be disposed of safely and a convenient method of disposing of low activity waste is to store it in sealed drums in underground salt or clay bed depositories, or to deposit the drum on the sea bed. During filling of the drums care must be taken to avoid contamination of the environment and the generally accepted procedure is to seal the closed drum to the initial waste dispenser (which may be a glovebox) before withdrawing the lid and dispenser closure into the dispenser in back-to-back manner, thereby to form an extension of the dispenser; after charging the waste, the drum and dispenser are both closed before breaking the seal between them. Conventional mechanisms for the procedure are complex and expensive, for example, the lid is secured to the drum (and to the dispenser closure in back-to-back manner) by a latch mechanism which calls for a complex drum structure and sealing means. Whilst the conventional mechanisms are acceptable in circumstances where it is required to be able to regain access to the drums, the cost of such complexity is unacceptable where no further access is required, for example, where the drums are to be disposed of on the sea bed, so an object of the invention is to provide a safe method of charging low activity waste into simply constructed drums having the conventional plug-in kind of closures.

SUMMARY OF THE INVENTION

According to the invention, in an improved method of charging low activity waste into an upright disposal drum having a closure plug wherein the drum is sealed to a waste dispenser by an interposed sealing member to form a closed extension thereof, drum and dispenser closures being withdrawn in back-to-back manner into the dispenser prior to charging waste into the drum, the improvement comprises compressing the sealing member in two stages a first stage prior to withdrawing the drum and dispenser closure combination into the dispenser and, subsequent to withdrawing the combination into the dispenser, a second stage whereby the drum is displaced towards the dispenser sufficient to enable full engagement of the closure plug in the drum when the drum and dispenser closure combination is restored to the dispenser closed position.

In a preferred method the second stage of compression of the sealing member occurs before the drug and dispenser closure combination in restored to the dispenser closed position thereby to effect simultaneous closure of the dispenser and drum by restoration of the combination but in an alternative method the second stage of compression of the sealing member occurs after the drum and dispenser closure combination is restored to the dispenser closed position, the second stage displacement thereby effecting closure of the drum.

Invention also resides in apparatus for charging low activity waste into a disposal drum, the apparatus comprising a waste dispenser having a port, a closure for the port, a drum having a flanged closure plug for a port therein, means for securing the closure and closure plug together in back-to-back manner, a first compressible sealing member interposed between the drum and dispenser when the ports are in register, and a second compressible sealing member disposed concentrically of the first sealing member and interposed between the drum and the flange of the closure plug arranged so that the closure plug is supported on the second sealing member prior to urging the closure plug into engagement with the port of the drum.

DESCRIPTION OF THE DRAWINGS

Apparatus for, and a method of, charging low activity waste into a disposal drum is described by way of example with reference to the accompanying diagrammatic drawings wherein FIGS. 1 to 6 are fragmentary sectional views of a dispenser and disposal drum and demonstrate successive steps of charging.

DESCRIPTION OF THE PREFERRED EMBODIMENTS

Figure 4:
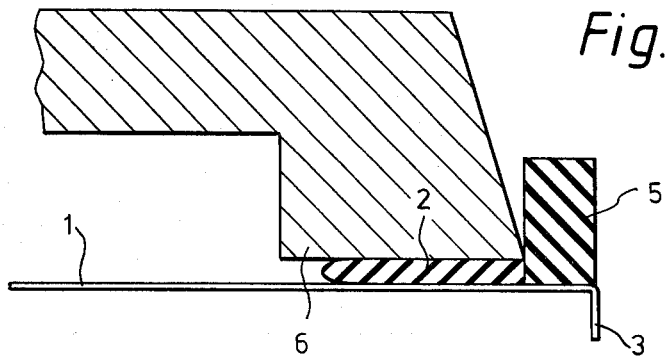

FIG. 1 shows a disposal drum 1 carrying on its upper end face a sealing member 2 of soft rubber for sealing the drum to a dispenser. A flanged closure plug 4 for the drum is made of steel and is supported in register, but clear of, the drum opening 3 by a second sealing member 5 of soft rubber disposed concentrically of the sealing member 2.

The disposal drum is presented to the dispenser by lifting to abut the sealing member 2 with the flange designated 6 of the port opening of the dispenser as shown in FIG. 2 the sealing member 2 being compressed to a first limit wherein a seal is effected between the dispenser and drum. The dispenser has a port closure designated 7 which seals on a tapered seating in the flange 6 and carries a sealing ring 8 for abutment with the flange of the closure plug 4.

The port closure 7 has electromagnetic means for attracting the closure plug whereby the port closure 7 and closure plug 4 can be lifted in back-to-back manner into the dispenser allowing the seal member 5 to expand into the port opening of the dispenser as shown in FIG. 3.

Figure 5:
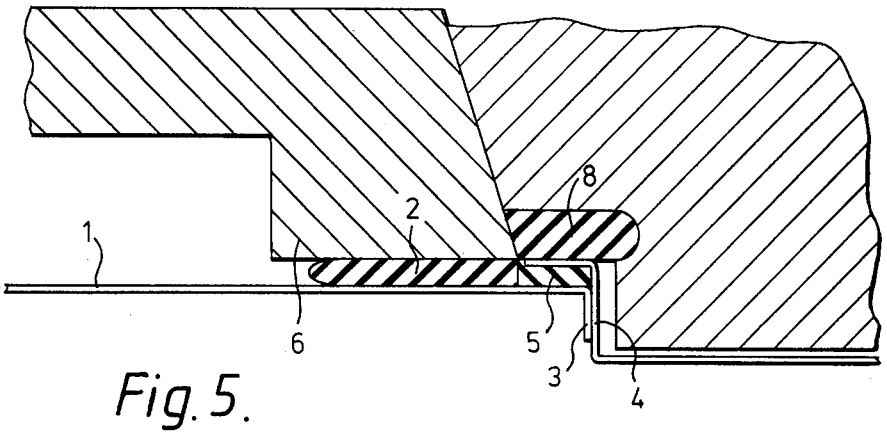

The drum is then lifted to compress the sealing member 2 to a second limit as shown in FIG. 4, and after charging waste into the drum the port closure 7 is brought into the closed position thereby pressing home the closure plug 4 as shown in FIG. 5.

Figure 6:
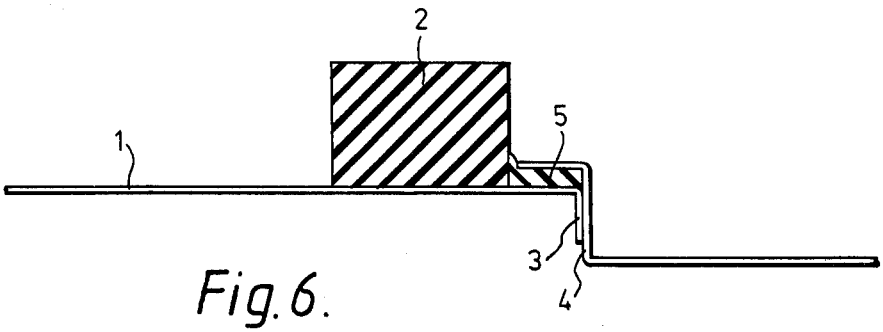

Removal of the drum frees the sealing member 2 as shown in FIG. 6 enabling it to be disposed of whilst the sealing member 5 is retained between the drum and flange of the closure plug to provide a secondary seal for the drum, the primary seal being constituted by an interference fit between the closure plug and drum.

In an alternative procedure instead of effecting the second compression of the sealing member 2 prior to charging the waste into the drum, charging is effected and the port of the dispenser closed before the second stage lifting of the drum thereby to press the closure plug into the drum.

In an alternative apparatus (not shown) the sealing member 2 is a bellows structure, and instead of the electromagnetic means the engagement of the drum closure plug with the dispenser closure is effected by a latching device or, alternatively, by vacuum means.

The described apparatus and method of charging low activity waste into disposal drums has economic advantage over the apparatus and techniques used hitherto in that simple cheaply-constructed storage drums can be utilised.

We claim:

1. In a method of charging low activity waste into an upright disposal drum having a single closure plug which is an interference fit in the drum when the closure plug occupies its closure position wherein the drum is sealed to a waste dispenser by an interposed sealing member on the drum to form a closed extension thereof, drum and dispenser closures being withdrawn in back-to-back manner into the dispenser prior to charging waste into the drum, the steps comprising compressing the interposed sealing member on the drum in two stages, a first stage of movement of the drum relative to the dispenser and prior to withdrawing the drum and dispenser closure combination into the dispenser, and, subsequent to withdrawing said combination into the dispenser, a second stage of movement of the drum relative to the dispenser sufficient to enable full interference fit engagement of the closure plug in the drum when the drum and dispenser closure combination is restored to the dispenser closed position.

2. A method according to claim 1 wherein the second stage of compression of the sealing member occurs before the drum and dispenser closure combination is restored to the dispenser closed position thereby to effect simultaneous closure of dispenser and drum by restoration of the combination.

3. A method according to claim 1 wherein the second stage of compression of the sealing member occurs after the drum and dispenser closure combination is restored to the dispenser closed position, the second stage displacement thereby effecting closure of the drum.

4. Apparatus for storing low activity waste comprising a waste dispenser having a port, a closure for the port, a drum having a flanged closure plug for sealing a port thereof by being an interference therein, means for securing the closure and closure plug together in back-to-back manner, a first compressible sealing member on the drum which is interposed between the drum and dispenser when the ports are in register, and a second compressible sealing member disposed concentrically of the first sealing member and interposed between the drum and the flange of the closure plug arranged so that the closure plug is supported on the second sealing member prior to urging the closure plug into interference fit engagement with the port of the drum so as to compress the second sealing member.

* * * * *